United States Patent [19]

Storm et al.

[11] Patent Number: 5,053,596

[45] Date of Patent: Oct. 1, 1991

[54] APPARATUS AND METHOD OF INDUCTION-HARDENING MACHINE COMPONENTS WITH PRECISE POWER OUTPUT CONTROL

[75] Inventors: John M. Storm; Spencer L. Gibbs, both of Canville, Ind.

[73] Assignee: Contour Hardening Investors, LP, Indianapolis, Ind.

[21] Appl. No.: 563,398

[22] Filed: Aug. 6, 1990

[51] Int. Cl.[5] ..... H05B 6/06; H05B 6/14

[52] U.S. Cl. ..... 219/10.77; 219/10.41; 219/10.59; 266/97; 266/126; 266/129; 323/319

[58] Field of Search ..... 219/10.77, 10.75, 10.59, 219/10.41; 266/96, 97, 78, 80, 125, 126, 129; 323/235, 319

[56] References Cited

U.S. PATENT DOCUMENTS

| | | | |
|---|---|---|---|
| 3,845,328 | 7/1989 | Storm et al | 219/10.59 |
| 4,112,287 | 9/1978 | Oates et al. | 219/10.77 |
| 4,317,975 | 3/1982 | Mizukawa et al. | 219/10.77 |
| 4,399,511 | 8/1983 | Jurek | 219/110 |
| 4,511,956 | 4/1985 | Dewan et al. | 219/10.77 |
| 4,626,978 | 12/1986 | Thouvenin | 219/10.77 |

*Primary Examiner*—Philip H. Leung
*Attorney, Agent, or Firm*—Woodward, Emhardt, Naughton, Moriasrty & McNett

[57] ABSTRACT

An induction-hardening machine for the contour hardening of machine components such as gears includes a system processor which controls thyristor power switching circuits which supply high-power signals to an RF generator. Power switching circuits include silicon controlled rectifiers of SCR's. In order to overcome the variable "on time" characteristics of SCR devices, a zero crossing detector is implemented and time periods are calculated so that the system processor activates the SCR circuits to supply power to the RF generator at predetermined times. The system processor 12 will deactivate the SCR circuits at or just prior to a zero crossing referenced from the predetermined activation time thereby effectively controlling the one time of the SCR circuits with an accuracy of up to five ten thousandths of a second. The signal produced by the RD generator is supplied to an induction heater coil which is used to case harden the gear teeth of a machine component or gear.

2 Claims, 3 Drawing Sheets

APPARATUS AND METHOD OF INDUCTION-HARDENING MACHINE COMPONENTS WITH PRECISE POWER OUTPUT CONTROL

BACKGROUND OF THE INVENTION

Field of the Invention

The present invention relates generally to the technology of induction heating and more particularly to the use of induction heating devices for case-hardening of machine components such as gears.

Machine components such as gears, splined shaves and sprockets are frequently subjected to high torque loads, frictional wear and impact loading. Gears of this type are typically used in power transmission drive trains. An apparatus and method for induction-hardening of such machine components is disclosed in U.S. Pat. No. 4,845,328 to Storm et al., the contents of which are hereinafter incorporated by reference. The Storm et al patent and this application are both owned by the same assignee, Contour Hardening Investors, Limited, of Indianapolis, Indiana.

As is well known in the art, a known device for gear teeth hardening includes a dual-frequency arrangement for induction heating wherein a low frequency current is used for preheating the gear teeth and then a high frequency (Radio Frequency) current is then used for final heating prior to quench hardening of the gear teeth. The dual frequency induction hardening concept is described in the article "Induction Gear Hardening by the Dual-Frequency Method" which appeared in *Heat Treating Magazine*, Vol. 19, No. 6, published in June, 1987.

As explained in the article, dual-frequency heating employs both high and low frequency heat sources. The gear is first induction heated with a relatively low frequency source (3–10 kHz), providing the energy required to preheat the mass of the gear teeth. This step is followed immediately by induction heating with a high-frequency source which typically ranges from 100–300 kHz depending on the gear size and diametral pitch of the gear teeth. The high-frequency source will rapidly final heat the entire tooth contour surface to a case hardening temperature. The gears are then quenched to a desired hardness and tempered.

Induction heating is the fastest known way of heating an iron alloy gear. In some applications a pre-heat low frequency heat process precedes the final heat RF heating. Heating times for the high-frequency RF heating step typically range from 0.10 to 2.0 seconds. In induction heating, the gear is mounted on a spindle and spun while positioned within the induction heating coil. A quick pulse of power is supplied to the induction heating coil which achieves an optimum final heat of the gear teeth. Next, the piece is manually or automatically moved into a water-based quench. Because induction hardening puts only the necessary amount of heat into the part, case depth requirements and distortion specifications are met with great accuracy.

Within the induction heating process, whether dual- or single frequency, and regardless of the type of part and its material, the part characteristics dictate the optimum design of both the induction heating coil or coils and the most appropriate machine settings. In particular, the amount of time that the high-frequency power signal is supplied to the induction heating coil to generate the final heat is a most critical parameter. The exact amount of heat required to harden the gear is directly related to the precise amount of time that the power signal is supplied to the induction heater coil.

Traditionally, there are two systems well-known in the art for supplying power to an induction heater coil as described above. The first system utilizes what is known in the art as a "solid state" generator approach wherein high power amplification devices such as transistors, be they bipolar or CMOS, are used in the high-frequency RF generator to supply a high-frequency oscillator signal to the induction heater coil. An alternate approach is to use a vacuum tube RF generator and utilize thyristor type devices to switch power on and off to the high-frequency, high power vacuum tube oscillator circuit. The output of either oscillator circuit is coupled to the induction heater coil by way of a transformer. Some experts in the art of induction heating coil machines designed for case hardening metallic structures have heretofore preferred the solid state high-frequency RF generators for their exact timed control of power delivery to the induction heater coil. A vacuum tube RF generator typically receives its input power subject to the on/off timing characteristics of thyristor devices such as silicon controlled rectifiers (SCRs) which are also known in their JEDEC description as reverse blocking triode thyristors. The power delivery timing variance created by the SCR is intrinsic in the operation of such devices. Specifically, once an SCR is "turned on" for a partial cycle, even though the on/off signal supplied to the gate is removed or deactivated, the SCR will continue to conduct current so long as the anode to cathode terminals are biased with a positive voltage. In the worst case of a 60-cycle power signal being transferred by the SCR, this results in over an 8 millisecond additional power signal transmitted by the SCR, since half of a 60-cycle waveform is 8.33 milliseconds in duration.

It is recognized that the vacuum tube RF generator is preferred by some in the induction heating art for its characteristic power delivery curve in supplying power to an induction heater coil. Additionally, since SCRs are the device of choice for repeated high power switching circuits, a technique for accurately controlling SCRs to deliver specific quantities of power to a high-power vacuum tube RF generator is needed.

A method and apparatus for more accurately controlling the timed power output of a silicon controlled rectifier power supply is needed for accurately controlling the power signal supplied to induction heater coils used in case hardening devices.

SUMMARY OF THE INVENTION

An apparatus for induction hardening machine components with precise control of power output, according to the present invention, comprises an AC power source for producing an AC power signal, zero-crossing detector means connected to the AC power source for detecting zero crossings of the AC power signal and procucing a zero-crossing signal corresponding thereto, a high-frequency generator having a power input and an output for producing a high-frequency, high-power signal in response to a signal supplied to the power input, a high-frequency induction heater coil sized to fit the gear and connected to the output of the generator, the coil generating a high-frequency electrical signal through the gear, thyristor power switching means having an activation input, a power input connected to the AC power source, and a power output, the power switching means producing an AC power signal at the power output in response to a signal supplied to the activation input, and processor means, connected to the zero-crossing detector and the thyristor power switching means activation input, for computing activation times and supplying a corresponding activation signal to the activation input, the processor means including: 1) means for entering a desired activation time, 2) means for computing a delay time so that the sum of the activation time and the delay time corresponds to a minimum whole number multiple of the period of the AC power signal, and 3) input means for receiving a user supplied manual cycle start input signal, the processor responding to a cycle start input signal by detecting a zero crossing signal and delaying a period of time equal to the delay time before supplying an activation signal to the activation input so that the activation signal is extinguished substantially simultaneously with a subsequent zero crossing of said AC power signal.

One object of the present invention is to provide an improved induction hardening machine.

Another object of the present invention is to provide a method for more accurately controlling the power signal supplied to induction heater coils of an induction hardening machine to precisely control the power supplied and thus the heating of a gear during case hardening.

Another object of the present invention is to provide a more accurate high power switching circuit so that the total power output signal can be controlled with greater precision.

These and other objects of the present invention will become more apparent from the following description of the preferred embodiment.

DESCRIPTION OF THE PREFERRED EMBODIMENT

Figure 1:
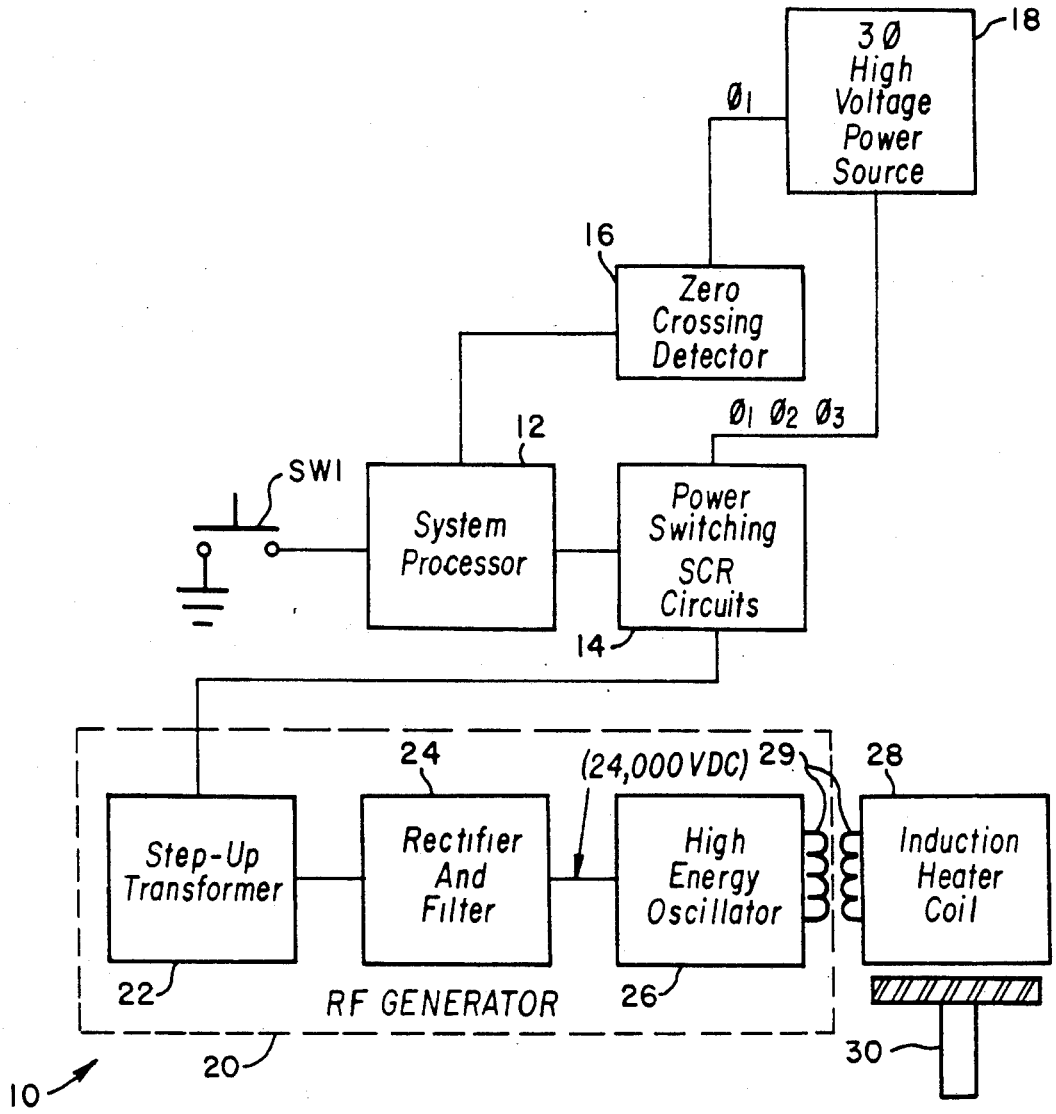
FIG. 1 is a block diagram of a typical embodiment of an induction-hardening system according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an induction-hardening system 10 according to the present invention is shown. Switch SW1 provides an activation signal to the system processor 12 for invoking or initiating the case hardening of a gear. System processor 12 is programmed by the user with timing parameters for controlling the power signal supplied to the induction heater coil. Processor 12 supplies an on/off power switching signal to power switching SCR circuit 14. System processor 12 receives a zero crossing indicator input signal from zero crossing detector 16. One phase $\phi_1$ from $3\phi$ high voltage power source 18 is supplied to an input of zero crossing detector 16. The $3\phi$ high-voltage power source 18 supplies three phases of high voltage power to the power switching SCR circuits 14. Power switching SCR circuits 14, when activated, supply either half-wave or full-wave AC power signals to the primary windings of step-up transformer 22. Transformer 22 steps up the AC power signals $\phi_1$, $\phi_2$ and $\phi_3$, typically 480 volts three-phase signals, to a voltage level sufficiently high that rectifier and filter 24 produces a 24,000 volts DC signal at its output.

The 24,000 volts DC signal at the output of rectifier filter 24 is the power source for a vacuum tube type high-energy RF oscillator 26. The output of the high-energy oscillator 26 is AC coupled to the induction heater coil 28 via windings 29. Induction heater coil 28 supplies a case-hardening heating signal to the gear teeth of gear 30 when an RF signal is supplied to its input.

The components 22, 24 and 26 of the system 10 are part of RF generator 20 which is a high-frequency, high-power RF generator. The RF generator 20 is an off-the-shelf system supplied by Pillar Industries, Inc., N92 W15800 Megal Drive, Menomonee Falls, Wis. 53051. The RF generator 20 is referred to as a "450/600 kilowatt RF Generator".

The particular geometry and physical attributes of gear 30 dictate the precise amount of time that power switching SCR circuits 14 are "turned on" by system processor 12 in order to produce the appropriate case hardening result. In some instances, the amount of time that the SCR circuits 14 are turned on is as small a time period as 0.10 seconds to accomplish the desired heating and case hardening of gear 30. With this condition in mind, it is easy to see why the prior art devices which did not include zero crossing detector 16, were unable to accurately control the amount of power signal or total power supplied to the induction heater coil 28.

The system processor 12 of the present invention typically includes a computer having adequate memory and computing capability, and a programming input device such as a CRT/keyboard device. Additionally the processor 12 has mass storage devices such as floppy or hard disk drives for use in storing and recalling control programs. Operationally speaking, an operator programs the system processor 12 through a keyboard for a particular "on-time" or heat time which is the exact time that the power switching SCR circuits 14 shall be turned on to supply a fixed quantity of high-frequency power signal to the induction heater coil 28. In response to the programmed "on time" information, the system processor 12 will compute a complement value for the specific "on time" which is equal to the difference between the "on time" divided by 8.33 milliseconds (the period of a 60 Hz waveform). The remainder from this calculation is subtracted from 8.33 milliseconds to produce a time value which is the delay time that the processor 12 should delay after detecting a zero crossing of the 60 Hz signal present at the input of detector 16 prior to activating the SCR circuits 14 to supply power to the RF generator. The time delay calculation is designed so that the end of the on or conducting period for the SCR devices corresponds exactly with or just prior to a zero crossing of the power signal $\phi_1$ supplied to the input of zero crossing detector 16. Thus, the SCR's, which remain in the conducting state so long as the anode to cathode terminals are forward biased, will not remain on a substantial period of time after the system processor 12 signals the SCR circuits 14 to turn off by deactivating the input to the circuits 14.

It is well known in the art that SCR circuits 14 may supply a half-wave or full-wave $3\phi$ output signal to the transformer 22. If the signal is half-wave in nature, the divide-by factor described above (8.33 milliseconds) becomes 16.67 milliseconds and the remainder is subtracted from 16.67 milliseconds. Additionally, negative-slope zero crossovers must be detected to determine the appropriate timing reference points for activating a half-wave output SCR circuit. Thus, the "on time" desired is divided by 16.67, and any remainder therefrom is subtracted from 16.67. The result of the subtraction process is the delay period required after a negative-slope zero crossover of the power signal prior to activating the SCR circuits 14 for half-wave outputs therefrom. Although the other phases ($\phi_2$ and $\phi_3$) of the SCR circuits 14 may remain "on" after the input to circuits 14 is deactivated, the above technique produces an accurate and repeatable power output from SCR circuits 14.

Figure 2:
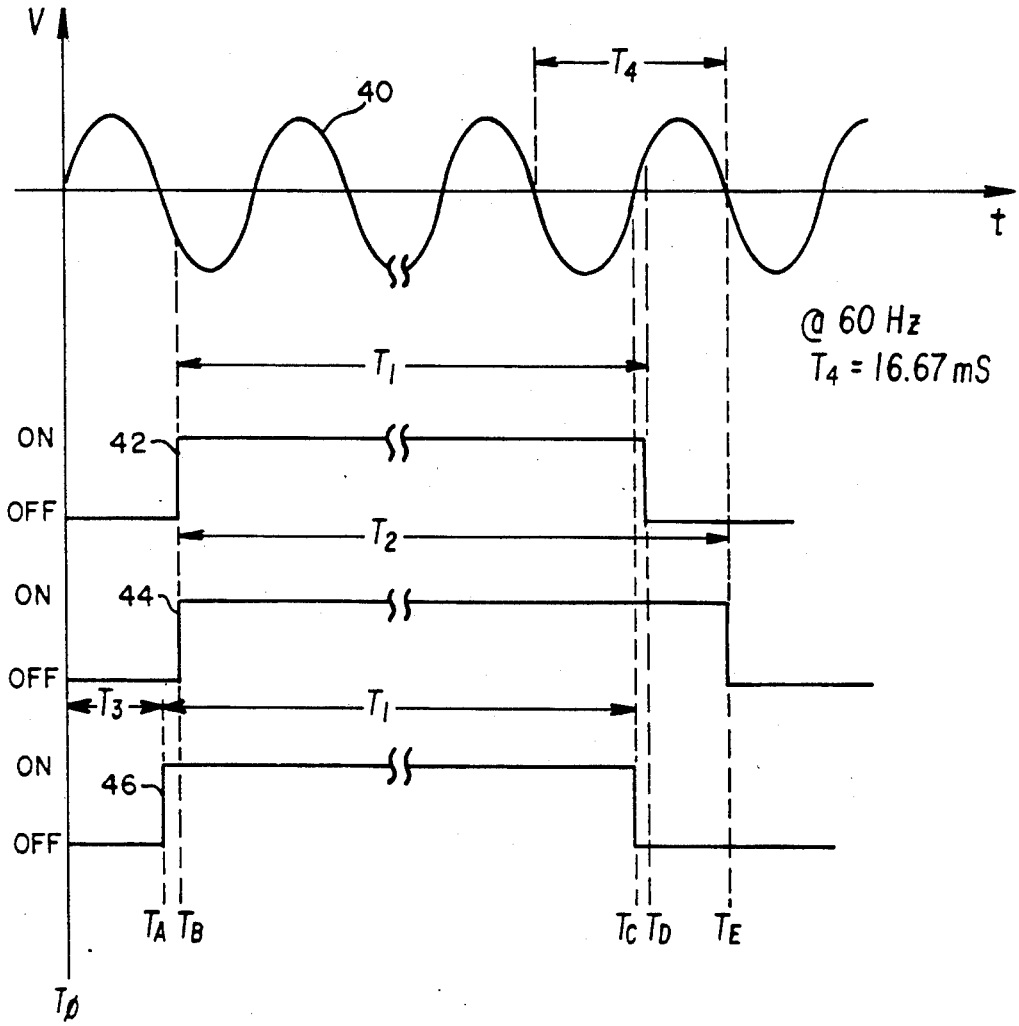
FIG. 2 is a timing diagram showing variations in the active or "on" state of an SCR with respect to certain input conditions applied to the gate of the SCR.

Referring now to FIG. 2, a timing diagram showing variations in active or "on" state of an SCR with respect to certain gate signal conditions is shown. Curve 40 is a standard sine wave power signal representing the $\phi_1$ signal at the input of detector 16. Curve 40 is a 60 Hz signal plotted with respect to time. Curves 42 and 46 represent the signal produced by the system processor 12 and supplied to the gate input of the SCR circuits 14. Curves 42 and 46 are the "on time" desired to produce a predetermined amount of heat in a particular gear 30 to be induction hardened.

The circuits 14 are activated or caused to supply a power signal to generator 20 at the point in time which is the off-on transition of the curve 42. At the end of the "on time" of curve 42, or time $T_D$, the signal changes from the "on" state to the "off" state. The precise timing of the on-off transition does not occur near a zero crossing of curve 40. Since the activation signal represented by curve 42 does not return to the "off" state until after the zero crossing at time $T_C$, the power signal which is supplied to the RF generator 20, represented by curve 44, is continuously "on" until time $T_e$, which may be as much as 8.33 milliseconds after the on-off transition of curve 42. Thus, if the on signal produced by system processor 12 begins at time $T_B$ and continues until time $T_D$, the total power signal supplied to the RF generator will last from time $T_B$ until time $T_E$ on the graph, for a total time period of $T_2$.

In order to precisely control the power supplied to the induction heater coil, and thus achieve more accurate control of the induction hardening process, the system according to the present invention computes a time delay beyond a zero crossing (here the zero crossing at $T_0$) for turning on the SCR circuits 14 so that the SCR activation signal, represented by curve 46, will change from the "on" state to the "off" state at or just prior to a zero crossing of curve 40. For example, in order to eliminate the additional "on time" of the power signal 44 as compared to the gate on-time input signal represented by curve 42 which switches the SCR circuits, the system processor 12 will compute a time $T_3$ which corresponds to the desired "on time" $T_1$ divided by 8.33 milliseconds and subtract the remainder from 8.33 milliseconds to produce time $T_3$. Then, the system processor delays activating SCR circuits 14 a period of time $T_3$ after a zero crossing so that the activation curve 46, which coincidentally is exactly equal in "on time" duration to curve 42, changes from the "on" to the "off" state at time $T_C$, which corresponds with a zero crossing of the power signal curve 40.

Since the curve 46 is so closely related at time $T_C$ to a zero crossing, an accurate amount of "on time" of the SCR circuits 14 is achieved, thereby accurately controlling the amount of time that power is supplied to RF generator 20 with precision not heretofore known with SCR circuits. In so doing, the amount of power which is supplied to induction heater coil 28 is accurately controlled. Thus, a tube type RF generator, which is preferred by some skilled in the art over the solid state semiconductor type high-frequency RF generators, may be used to produce an accurate quantity of power signal and a correspondingly precise quantity of power supplied to the induction heater coil 28.

Although only one phase ($\phi_1$) of the power source 18 is shown in FIG. 2, it should be apparent to one skilled in the art that in a $3\phi$ system all three phases are related by 120 degrees. Thus, a fixed amount of additional power signal will be supplied by the other phases ($\phi_2$ and $\phi_3$) of the power source 18 beyond the time $T_C$ with the activation signal represented by curve 46. Nevertheless, the additional power supplied by the other two phases will be a constant quantity since the deactivation signal occurs at a predetermined time and phase relative to the other power phases. Therefore, the amount of power delivered to the gear 30 by the system 10 is repeatable by establishing a fixed timing reference (with respect to one phase) for switching on and off a $3\phi$ power source.

Figure 3:
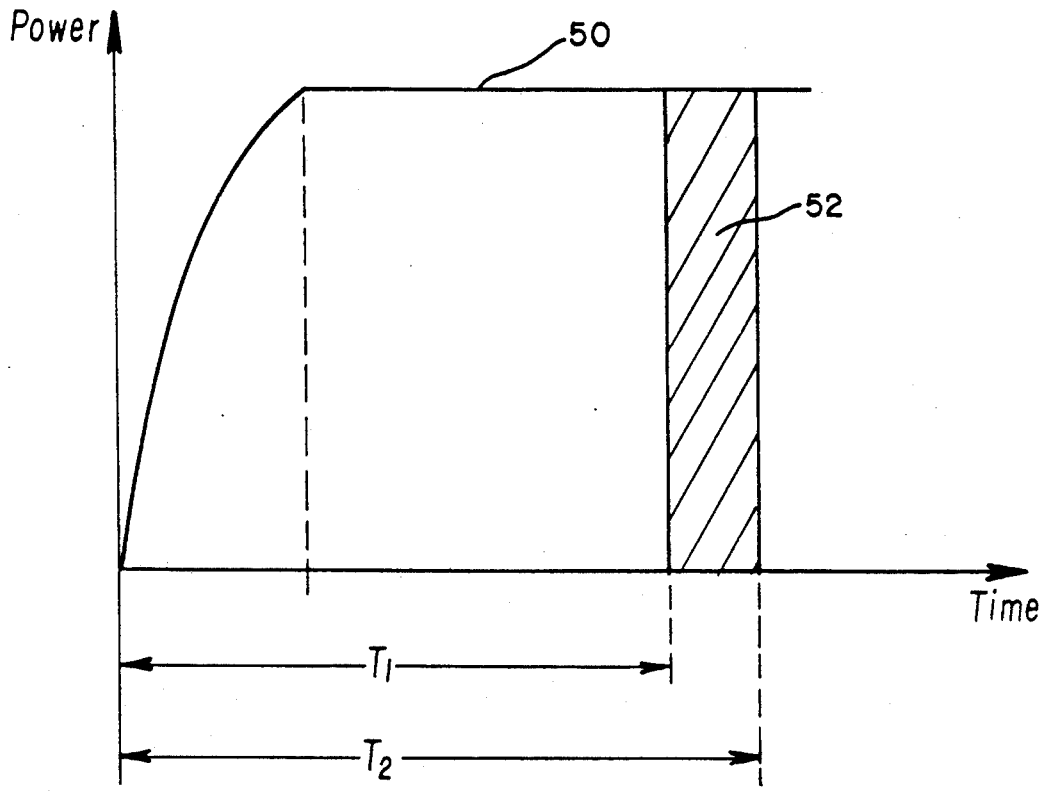
FIG. 3 is a graph depicting a deviation in power output signals produced by power switching SCR circuits of the present invention as compared with prior art devices.

Referring now to FIG. 3, a graph of the power output of the RF generator 20 is shown. The maximum power output of the generator 20, represented by curve 50, can be adjusted vertically to achieve higher or lower total instantaneous power output. The variance in "on time", represented by times $T_1$ and $T_2$, as a result of the intrinsic functionality of SCR circuits is shown at the bottom of the graph. If the SCR circuits remain on for a length of time $T_2$ as opposed to $T_1$, which is the desired "on time", the additional power represented by the shaded portion 52 underneath the curve 50 is supplied to the heater coil 28 in addition to the actual desired power, represented by the unshaded portion underneath the curve 50 and extending up to the end of time T1. The additional amount of power supplied to the induction heater coil 28 causes excessive heating of the gear 30.

As is seen in the graph of FIG. 3, timing variations make for greater variations in the case hardening process, particularly when the "on time" T1 is approximately 0.10 seconds. The maximum difference between times T2 and T1 can be as much as 8.33 milliseconds, and thus the power represented by area 52 can represent as much as 8–10% difference in power supplied to the induction heater coil 28 when a 0.10 second power signal is desired for heater coil 28. Another recognized fact is that once the gear 30 has been heated, the additional heating time represented by the area 52 can seriously increase the heat of the gear, as the heat transfer properties of the gear are non-linear and cause heat to transfer deeper into the gear face once the gear is heated around the perimeter. Thus, it is highly desirable to control the power supplied to the induction heater coil 28 via the technique shown and described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An induction-hardening machine for contour hardening of a gear comprises:

an AC power source for producing an AC power signal;

zero-crossing detector means connected to said AC power source for detecting zero crossings of said AC power signal and producing a zero-crossing signal corresponding thereto;

a high-frequency generator having a power input and an output for producing a high-frequency high-power signal in response to a signal supplied to said power input;

a high-frequency induction heater coil sized to fit said gear and connected to said output of said generator, said coil generating a high-frequency electrical signal through said gear;

thyristor power switching means having an activation input, a power input connected to said AC power source, and a power output, said power switching means supplying an AC power signal to said power input of said high-frequency generator in response to a signal supplied to said activation input; and processor means, connected to said zero-crossing detector and said thyristor power switching means activation input, for computing activation times and supplying a corresponding activation signal to said activation input, said processor means including:

1) means for entering a desired activation time;

2) means for computing a delay time so that the sum of the activation time and the delay time corresponds to a minimum whole number multiple of the period of said AC power signal; and 3) input means for receiving a user supplied manual cycle start input signal;

said processor responding to a cycle start input signal by detecting a zero crossing signal and delaying a period of time equal to said delay time before supplying an activation signal to said activation input so that the activation signal is extinguished substantially simultaneously with a subsequent zero crossing of said AC power signal.

2. A method for accurately controlling heating of a gear from an induction-hardening device, the induction-hardening device including an AC power source, thyristor power switching means having an activation input for producing a power signal in response to a signal appearing at the activation input, an RF generator responsive to said power signal to produce a high-frequency, high-power signal, and an induction heater coil connected to said FR generator and producing an electrical signal in the gear in response to the high-frequency, high-power signal, said method comprising the steps of:

determining a desired activation time for supplying power to the induction heater coil based upon the geometry of the gear;

dividing the desired activation time by one-half the period of the AC power supply signal to produce a remainder quantity;

subtracting the remainder quantity from one-half the period of the AC power supply signal to produce a delay time;

detecting a zero crossing of said AC power supply signal; and supplying an activation signal to the activation input of said thyristor power switching means for a time period corresponding to said activation time after a time equal to said delay time has expired.

* * * * *

UNITED STATES PATENT AND TRADEMARK OFFICE

CERTIFICATE OF CORRECTION

PATENT NO. : 5,053,596

DATED : October 1, 1991

INVENTOR(S) : John M. Storm, et al

It is certified that error appears in the above-identified patent and that said Letters Patent is hereby corrected as shown below:

On the title page:
In the second column of the title page, the Attorney, Agent or Firm name should be corrected to read --Woodard, Emhardt, Naughton, Moriarty & McNett--.

In line 17 of the Abstract please change "RD" to --RF--.

In column 8, line 22, please change "FR" to --RF--.

Signed and Sealed this

Second Day of March, 1993

*Attest:*

STEPHEN G. KUNIN

*Attesting Officer*

*Acting Commissioner of Patents and Trademarks*